US005911262A

United States Patent [19]

Steinhart

[11] Patent Number: 5,911,262

[45] Date of Patent: Jun. 15, 1999

[54] HANDBAG

[76] Inventor: Elyse A. Steinhart, 6840 NW. 26th Ave., Fort Lauderdale, Fla. 33309

[21] Appl. No.: 09/031,472

[22] Filed: Feb. 26, 1998

[51] Int. Cl.[6] ..... A45C 3/08

[52] U.S. Cl. ..... 150/103; 383/111; 150/104; 150/113; 150/115; 150/117; 190/110; 190/112; 190/111

[58] Field of Search ..... 150/103, 104, 150/105, 113, 114, 117; 190/110, 111, 112; 383/111

[56] References Cited

U.S. PATENT DOCUMENTS

| | | | |
|---|---|---|---|
| D. 269,883 | 7/1983 | Cavnar et al. | D21/59 |
| 2,053,464 | 9/1936 | Dalsheim | 150/104 X |
| 4,112,991 | 9/1978 | Barbaresi | 150/104 X |
| 4,250,938 | 2/1981 | Siegel | 150/103 X |
| 4,929,094 | 5/1990 | Becker | 383/111 X |
| 5,009,319 | 4/1991 | Jantzen | 150/104 X |

*Primary Examiner*—Gary E. Elkins
*Assistant Examiner*—Tri M. Mai

[57] ABSTRACT

A new handbag for allowing a user to organize and store the contents of a purse so that the contents may be easily transferred between variously designed and colored handbags. The inventive device includes an inner handbag disposed within an outer handbag. The inner handbag includes an inner shell with front and rear storage flaps pivotally coupled thereto. The inner shell defines an inner compartment for holding items and the front and rear storage flaps have loops, pockets, and pouches for holding items such as cosmetics, credit cards, and checkbooks. The outer handbag includes an outer shell and a closure flap. The inner shell is disposed within the main compartment of the outer shell. The front storage flap is inserted through a front slot in the front panel of the outer shell. Similarly, the rear storage flap is inserted through a rear slot in the rear panel of the outer shell.

14 Claims, 2 Drawing Sheets

HANDBAG

BACKGROUND OF THE INVENTION

1. Field of the Invention

The present invention relates to handbags and more particularly pertains to a new handbag for allowing a user to organize and store the contents of a purse so that the contents may be easily transferred between variously designed and colored handbags.

2. Description of the Prior Art

The use of handbags is known in the prior art. More specifically, handbags heretofore devised and utilized are known to consist basically of familiar, expected and obvious structural configurations, notwithstanding the myriad of designs encompassed by the crowded prior art which have been developed for the fulfillment of countless objectives and requirements.

Known prior art handbags include U.S. Pat. No. 4,250,938; U.S. Pat. No. 4,192,365; U.S. Pat. No. Des. 324,770; U.S. Pat. No. 4,532,972; U.S. Pat. No. 4,591,054; and U.S. Pat. No. 4,098,312.

While these devices fulfill their respective, particular objectives and requirements, the aforementioned patents do not disclose a new handbag. The inventive device includes an inner handbag disposed within an outer handbag. The inner handbag includes an inner shell with front and rear storage flaps pivotally coupled thereto. The inner shell defines an inner compartment for holding items and the front and rear storage flaps have loops, pockets, and pouches for holding items such as cosmetics, credit cards, and checkbooks. The outer handbag includes an outer shell and a closure flap. The inner shell is disposed within the main compartment of the outer shell. The front storage flap is inserted through a front slot in the front panel of the outer shell. Similarly, the rear storage flap is inserted through a rear slot in the rear panel of the outer shell.

In these respects, the handbag according to the present invention substantially departs from the conventional concepts and designs of the prior art, and in so doing provides an apparatus primarily developed for the purpose of allowing a user to organize and store the contents of a purse so that the contents may be easily transferred between variously designed and colored handbags.

SUMMARY OF THE INVENTION

In view of the foregoing disadvantages inherent in the known types of handbags now present in the prior art, the present invention provides a new handbag construction wherein the same can be utilized for allowing a user to organize and store the contents of a purse so that the contents may be easily transferred between variously designed and colored handbags.

The general purpose of the present invention, which will be described subsequently in greater detail, is to provide a new handbag apparatus and method which has many of the advantages of the handbags mentioned heretofore and many novel features that result in a new handbag which is not anticipated, rendered obvious, suggested, or even implied by any of the prior art handbags, either alone or in any combination thereof.

To attain this, the present invention generally comprises an inner handbag disposed within an outer handbag. The inner handbag includes an inner shell with front and rear storage flaps pivotally coupled thereto. The inner shell defines an inner compartment for holding items and the front and rear storage flaps have loops, pockets, and pouches for holding items such as cosmetics, credit cards, and checkbooks. The outer handbag includes an outer shell and a closure flap. The inner shell is disposed within the main compartment of the outer shell. The front storage flap is inserted through a front slot in the front panel of the outer shell. Similarly, the rear storage flap is inserted through a rear slot in the rear panel of the outer shell.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new handbag apparatus and method which has many of the advantages of the handbags mentioned heretofore and many novel features that result in a new handbag which is not anticipated, rendered obvious, suggested, or even implied by any of the prior art handbags, either alone or in any combination thereof.

It is another object of the present invention to provide a new handbag which may be easily and efficiently manufactured and marketed.

It is a further object of the present invention to provide a new handbag which is of a durable and reliable construction.

An even further object of the present invention is to provide a new handbag which is susceptible of a low cost of manufacture with regard to both materials and labor, and which accordingly is then susceptible of low prices of sale to the consuming public, thereby making such handbag economically available to the buying public.

Still yet another object of the present invention is to provide a new handbag which provides in the apparatuses and methods of the prior art some of the advantages thereof, while simultaneously overcoming some of the disadvantages normally associated therewith.

Still another object of the present invention is to provide a new handbag for allowing a user to organize and store the contents of a purse so that the contents may be easily transferred between variously designed and colored handbags.

Yet another object of the present invention is to provide a new handbag which includes an inner handbag disposed within an outer handbag. The inner handbag includes an inner shell with front and rear storage flaps pivotally coupled thereto. The inner shell defines an inner compartment for holding items and the front and rear storage flaps have loops, pockets, and pouches for holding items such as cosmetics, credit cards, and checkbooks. The outer handbag includes an outer shell and a closure flap. The inner shell is disposed within the main compartment of the outer shell. The front storage flap is inserted through a front slot in the front panel of the outer shell. Similarly, the rear storage flap is inserted through a rear slot in the rear panel of the outer shell.

Still yet another object of the present invention is to provide a new handbag that reduces the frustration in transferring items between handbags.

Even still another object of the present invention is to provide a new handbag that helps reduce the risk of leaving items behind when transferring items from one handbag to another handbag.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
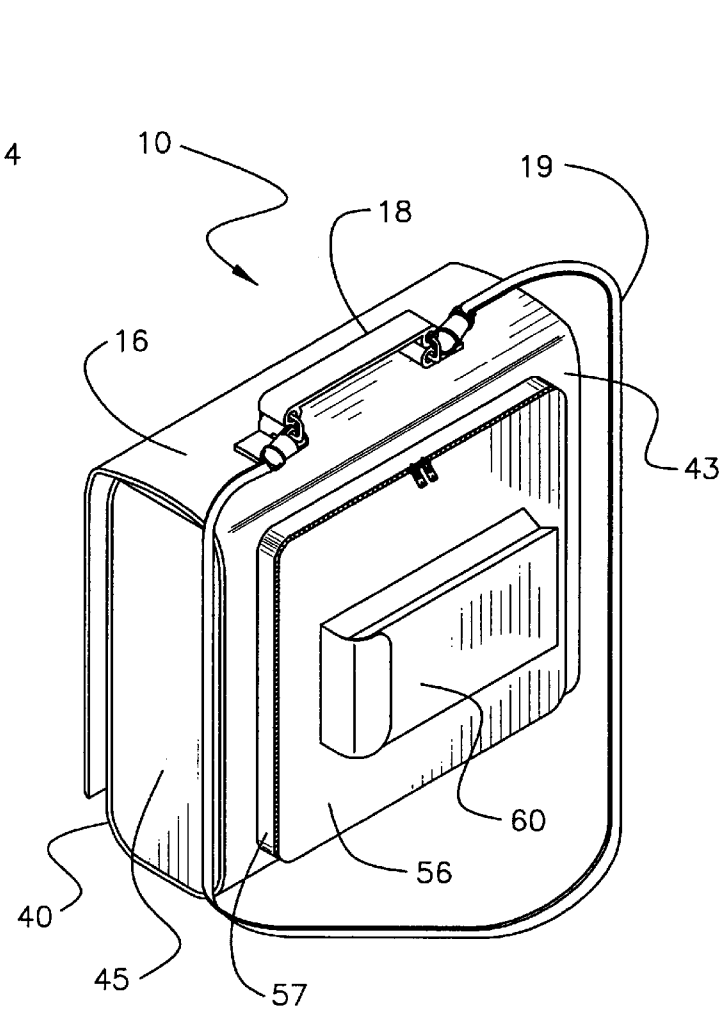
FIG. 2 is a schematic perspective view of the rear side of the present invention illustrating the glasses pouch.

With reference now to the drawings, and in particular to FIGS. 1 through 5 thereof, a new handbag embodying the principles and concepts of the present invention and generally designated by the reference numeral 10 will be described.

As best illustrated in FIGS. 1 through 5, the handbag 10 generally comprises an inner handbag 12 disposed within an outer handbag 14. The inner handbag 12 is designed so that, in use, it may be inserted into variously styled and colored outer handbags 14. The inner handbag 12 includes an inner shell 20 with front and rear storage flaps 30, 35 pivotally coupled thereto. The outer handbag includes an outer shell 40 and a closure flap 16. The inner shell 20 is disposed within the main compartment 41 of the outer shell 40. The front storage flap 30 is inserted through a front slot 46 in the front panel 42 of the outer shell. Similarly, the rear storage flap 35 is inserted through a rear slot 47 in the rear panel 43 of the outer shell.

Figure 3:
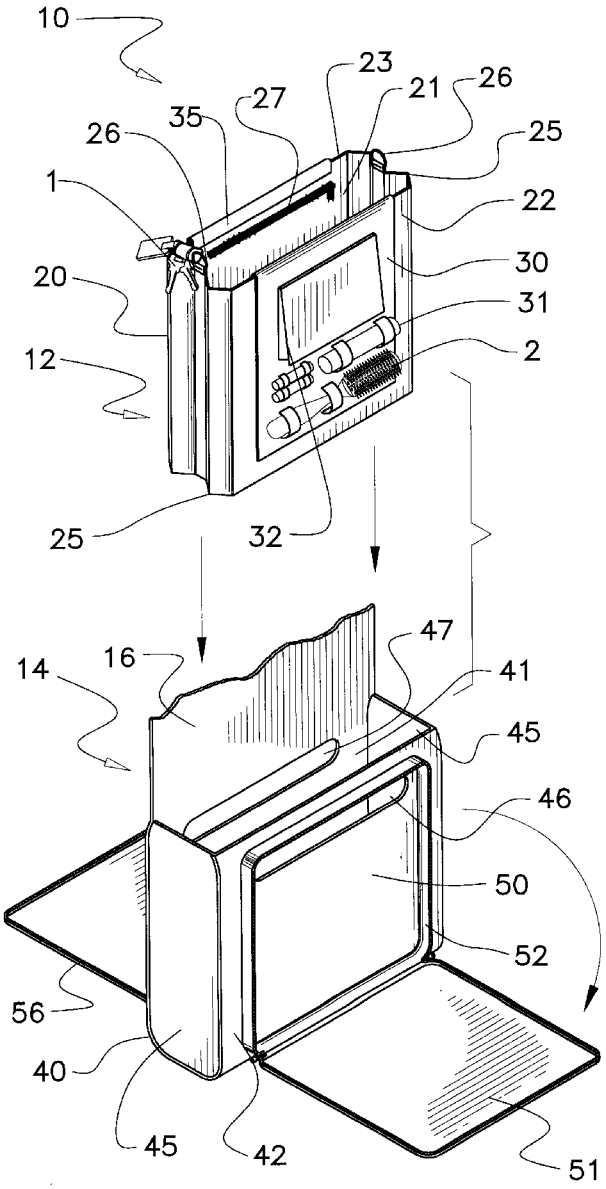
FIG. 3 is a schematic exploded perspective view of the present invention of the closure flap in the open position.

The inner shell 20 has an main compartment 21 for holding items that is defined between the front panel 22, the rear panel 23, the bottom panel (not shown) and the pair of spaced-apart side walls 25 of the inner shell 20. The side walls 25 extend between the front and rear panels 22, 23 and are preferably folded in an accordion-fold manner to permit expanding and contracting of the main compartment 21. As shown in FIG. 3, each of the side walls 25 have a ring member 26 located on their upper edge for attaching items, such as keys and key chains 1, thereto. Ideally, the rear panel 23 also has a closable pocket 27 with an opening on the interior surface of the shell rear panel 23 facing into the main compartment 21. As shown in FIG. 3, the pocket opening 27 may be closable by means of a zipper.

Figure 5:
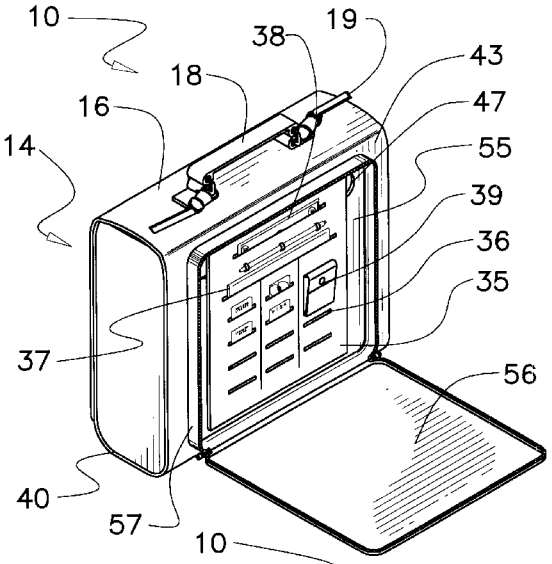
FIG. 5 is a schematic perspective view of the back side of the present invention detailing the rear compartment and the rear storage flap.
Figure 4:
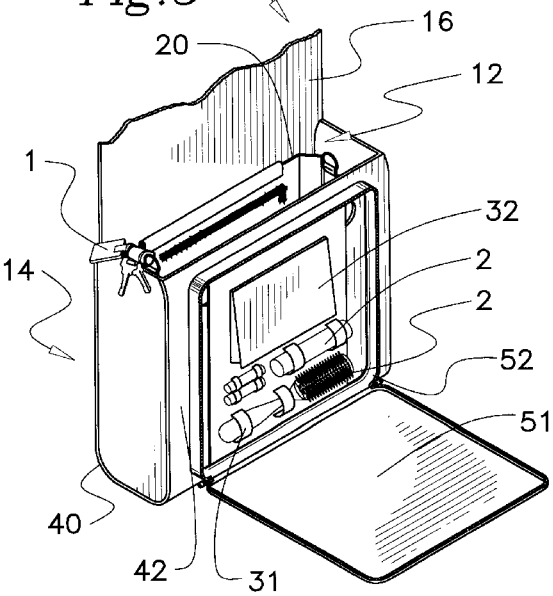
FIG. 4 is a schematic partial perspective view of the front side of the present invention.

The front and rear storage flaps 30, 35 are each pivotally coupled to the upper edge of their respective inner shell panel 22, 23. Both flaps 30, 35 include item holding means for holding items to them. As illustrated in FIG. 4, the item holding means on the front storage flap 30 include a plurality of holding loops for holding items, such as cosmetics and hair brushes 2, to the front storage flap 30. In an ideal embodiment, the item holding means of the front storage flap 30 also includes a pouch 32 for holding items, such as cosmetics and make-up mirrors therein. As shown in FIG. 5, the item holding means of the rear storage flap 35 preferably includes a plurality of storage pockets for holding items. Ideally, the storage pockets include a plurality of card storage pockets 36 for holding credit cards and business cards, a check book storage pocket 37 for holding a check book, and a money storage pocket 38 for holding paper currency. The item holding means of the rear storage flap 35 may also include a change pouch 39 for holding coinage.

Like the inner shell, the outer shell 40 is constructed having a front panel 42, a rear panel 43, a bottom panel (not shown), and a pair of spaced apart side walls 45 that define between them the main compartment 41 of the outer shell.

Figure 1:
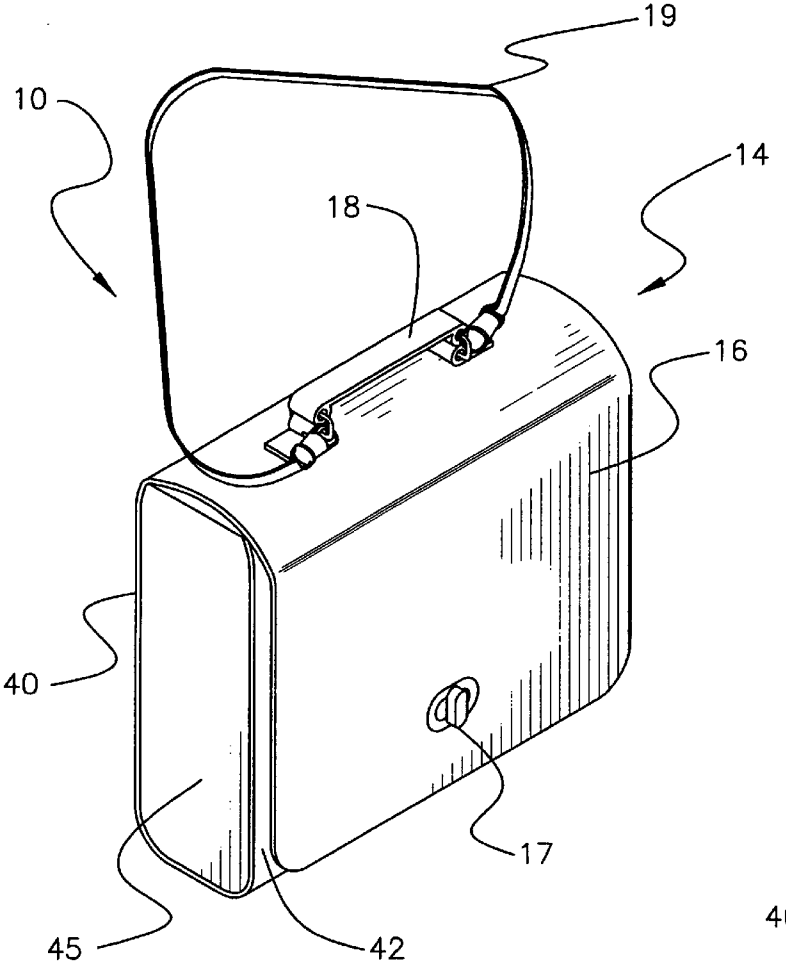
FIG. 1 is a schematic perspective view of the front side of a new handbag according to the present invention showing the closure flap in the closed position.

The outer shell closure flap 16 has a carrying handle 18 and a shoulder strap 19 extending from its outer surface and is pivotally coupled to the upper edge of the outer shell rear wall 43. The closure flap 16 is pivotable between a closed position, as shown in FIGS. 1 and 2, and an open position, as shown in FIGS. 3 and 4, permitting free access to the main compartment 41. When the outer shell closure flap 16 is positioned in the closed position, the closure flap 16 substantially covers the main compartment 41 of the outer shell and the outer surface of the outer shell front panel 42. The outer shell closure flap 16 in the closed position is also detachably couplable to the front panel 42 by a fastener, such as a clasp.

A front closure flap 51 is pivotally coupled to the outer surface of the outer shell front panel 42 with the outer perimeter of the front closure flap detachably couplable to the outer surface of the outer shell front panel 42 to define a front compartment 50 for covering the front storage flap 30. With reference to FIG. 3, the front compartment 50 is preferably defined by the front closure flap 51 and a front side wall 52 extending from the outer surface of the front panel 42 of the outer shell and encompassing the front slot 46 and the front storage flap 30. In this preferred embodiment, the front closure flap 51 is pivotally coupled to the front side wall 52 with the outer perimeter of the front closure flap 51 detachably couplable to the front side wall 52, ideally by means of a zipper.

Similarly, the invention 10 includes a rear closure flap 56 pivotally coupled to the outer surface of the outer shell rear panel 43 with the outer perimeter of the rear closure flap 56 detachably couplable to the outer surface of the outer shell rear panel 43 to define a rear compartment 55 for covering the rear storage flap 35. As shown in FIG. 5, the rear compartment 55 is preferably defined by the rear closure flap 56 and a rear side wall 57 extending from the outer surface of the rear panel 43 of the outer shell and encompassing the rear slot 47 and the rear storage flap 35. In this preferred embodiment, the rear closure flap 55 is pivotally coupled to the rear side wall 57 with the outer perimeter of the rear closure flap 56 detachably couplable to the rear side wall 57, ideally by means of a zipper.

Ideally, as depicted in FIG. 2, the invention 10 also includes a glasses pouch 60 for storing optical glasses is provided on the outer surface of the rear closure flap 56.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A handbag system comprising:

an inner handbag including:

an inner shell having a front panel, a rear panel, a bottom panel, and a pair of spaced-apart side walls extending between said inner shell front and rear panels, said inner shell front, rear, bottom panels and said inner shell side walls defining an inner shell main compartment therebetween, said inner shell front panel having an upper edge, said inner shell rear panel having an upper edge;

a front storage flap pivotally coupled to said upper edge of said inner shell front panel, said front storage flap having item holding means for holding items to said front storage flap; and a rear storage flap pivotally coupled to said upper edge of said inner shell rear panel, said rear storage flap having item holding means for holding items to said rear storage flap; and an outer handbag including:

an outer shell having a front panel, a rear panel, a bottom panel, and a pair of spaced apart side walls, said front panel, said rear panel, said bottom panel and said side walls defining an outer shell main compartment therebetween, said outer shell front panel having a front slot, and an outer surface, said outer shell rear panel having a rear slot, an outer surface, and an upper edge;

wherein said inner shell is disposed within said outer shell main compartment;

wherein said front storage flap is inserted through said outer shell front panel front slot;

wherein said rear front storage flap is inserted through said outer shell rear panel rear slot;

an outer shell closure flap pivotally coupled to said upper edge of said outer shell rear wall, said outer shell closure flap being pivotable between an open position and a closed position, said outer shell closure flap substantially covering said outer shell main compartment and said outer surface of said outer shell front panel when positioned in said closed position, said outer shell closure flap being detachably couplable to said outer shell front panel when in said closed position, said outer shell closure flap open position permitting free access to said outer body shell main compartment, said outer shell closure flap having an outer surface, said outer shell closure flap outer surface having a carrying handle and a shoulder strap extending therefrom;

a front closure flap being pivotally coupled to said outer shell front panel outer surface, the outer perimeter of said front compartment front closure flap being detachably couplable to said outer shell front panel outer surface to define a front compartment; and a rear closure flap being pivotally coupled to said outer shell rear panel outer surface, the outer perimeter of said rear compartment rear closure flap being detachably couplable to said outer shell rear panel outer surface to define a rear compartment.

2. The handbag system of claim 1, further comprises a second outer handbag for accepting said inner handbag, said second outer handbag including:

a second outer shell having a front panel, a rear panel, a bottom panel, and a pair of spaced apart side walls, said front panel, said second outer shell rear panel, said bottom panel and said side walls defining an second outer shell main compartment therebetween, said second outer shell front panel having a front slot, and an outer surface, said second outer shell rear panel having a rear slot, an outer surface, and an upper edge;

a second outer shell closure flap pivotally coupled to said upper edge of said second outer shell rear wall, said second outer shell closure flap being pivotable between an open position and a closed position, said second outer shell closure flap substantially covering said second outer shell main compartment and said outer surface of said second outer shell front panel when positioned in said closed position, said second outer shell closure flap being detachably couplable to said second outer shell front panel when in said closed position, said second outer shell closure flap open position permitting free access to said second outer body shell main compartment, said second outer shell closure flap having an outer surface, said second outer shell closure flap outer surface having a carrying handle and a shoulder strap extending therefrom;

a second front closure flap being pivotally coupled to said second outer shell front panel outer surface, the outer perimeter of said second front compartment front closure flap being detachably couplable to said second outer shell front panel outer surface to define a second front compartment; and a second rear closure flap being pivotally coupled to said second outer shell rear panel outer surface, the outer perimeter of said second rear compartment rear closure flap being detachably couplable to said second outer shell rear panel outer surface to define a second rear compartment.

3. The handbag system of claim 1, wherein said inner shell side walls are accordion-folded to permit expanding and contracting of said inner shell main compartment.

4. The handbag system of claim 1, wherein each said inner shell side wall have a ring member located on said inner shell side wall upper edge, each said ring member being for attaching items thereto.

5. The handbag system of claim 1, wherein said inner shell rear panel has an interior surface facing into said inner shell main compartment, said inner shell rear panel having a closable pocket therein having a closable opening on said inner shell rear panel interior surface.

6. The handbag system of claim 1, wherein said front storage flap item holding means includes a plurality of holding loops for holding items to said front storage flap.

7. The handbag system of claim 1, wherein said front storage flap item holding means includes a pouch for holding items therein.

8. The handbag system of claim 1, wherein said rear storage flap item holding means includes a plurality of storage pockets for holding items.

9. The handbag system of claim 8, wherein said rear storage flap storage pockets include a plurality of card storage pocket for holding credit cards, a check book storage pocket for holding a check book, and a money storage pocket for holding paper currency.

10. The handbag system of claim 1, wherein said rear storage flap item holding means includes a change pouch for holding coinage.

11. The handbag system of claim 1, further comprising a front side wall, and wherein said front compartment is defined by said front side wall and said front closure flap, said front compartment front side wall being extended from said outer shell front panel outer surface, said front compartment front side wall encompassing said outer shell front slot and said front storage flap, said front compartment front closure flap being pivotally coupled to said front compartment front side wall, the outer perimeter of said front compartment front closure flap being detachably couplable to said front compartment front side wall.

12. The handbag system of claim 1, further comprising a glasses pouch for storing optical glasses therein, and wherein said rear compartment rear closure flap has an outer surface, said glasses pouch being provided on said rear compartment rear closure flap outer surface.

13. The handbag system of claim 1, further comprising a rear side wall, and wherein said rear compartment is defined by said rear side wall and said rear closure flap, said rear compartment rear side wall being extended from said outer shell rear panel outer surface, said rear compartment rear side wall encompassing said outer shell rear slot and said rear storage flap, said rear compartment rear closure strap being pivotally coupled to said rear compartment rear side wall, the outer perimeter of said rear compartment rear closure strap being detachably couplable to said rear compartment rear side wall.

14. A handbag system comprising:

an inner handbag including:

an inner shell having a front panel, a rear panel, a bottom panel, and a pair of spaced-apart accordion-folded side walls extending between said inner shell front and rear panels, said inner shell front, rear, bottom panels and said inner shell side walls defining an inner shell main compartment therebetween, said inner shell front panel having an upper edge, said inner shell rear panel having an upper edge, said inner shell side walls each having an upper edge, each said inner shell side wall having a ring member being located on said inner shell side wall upper edge, each said ring member being for attaching items thereto, said inner shell rear panel having an interior surface facing into said inner shell main compartment, said inner shell rear panel having a closable pocket therein having a closable opening on said inner shell rear panel interior surface;

a front storage flap pivotally coupled to said upper edge of said inner shell front panel, said front storage flap having a plurality of holding loops for holding items to said front storage flap, said front storage flap having a pouch for holding items therein;

a rear storage flap pivotally coupled to said upper edge of said inner shell rear panel, said rear storage flap having a plurality of storage pockets for holding items, said rear storage flap storage pockets including: a plurality of card storage pocket for holding credit cards, a check book storage pocket for holding a check book, and a money storage pocket for holding paper currency, said rear storage flap including a change pouch for holding coinage; and an outer handbag including:

an outer shell having a front panel, a rear panel, a bottom panel, and a pair of spaced apart side walls, said front panel, said rear panel, said bottom panel and said side walls defining an outer shell main compartment therebetween, said outer shell front panel having a front slot, an outer surface, and an upper edge, said outer shell rear panel having a rear slot, an outer surface, and an upper edge;

an outer shell closure flap pivotally coupled to said upper edge of said outer shell rear wall, said outer shell closure flap being pivotable between an open position and a closed position, said outer shell closure flap substantially covering said outer shell main compartment and said outer surface of said outer shell front panel when positioned in said closed position, said outer shell closure flap being detachably couplable to said outer shell front panel when in said closed position, said outer shell closure flap open position permitting free access to said outer body shell main compartment, said outer shell closure flap having an outer surface, said outer shell closure flap outer surface having a carrying handle and a shoulder strap extending therefrom;

wherein said inner shell is disposed within said outer shell main compartment;

wherein said front storage flap is inserted through said outer shell front panel front slot;

wherein said rear front storage flap is inserted through said outer shell rear panel rear slot;

a front compartment being defined by a front side wall and a front closure flap, said front compartment front side wall being extended from said outer shell front panel outer surface, said front compartment front side wall encompassing said outer shell front slot and said front storage flap, said front compartment front closure flap being pivotally coupled to said front compartment front side wall, the outer perimeter of said front compartment front closure flap being detachably couplable to said front compartment front side wall;

a rear compartment being defined by a rear side wall and a rear closure flap, said rear compartment rear side wall being extended from said outer shell rear panel outer surface, said rear compartment rear side wall encompassing said outer shell rear slot and said rear storage flap, said rear compartment rear closure strap being pivotally coupled to said rear compartment rear side wall, the outer perimeter of said rear compartment rear closure strap being detachably couplable to said rear compartment rear side wall, said rear compartment rear closure flap having an outer surface; and a glasses pouch being provided on said rear compartment rear closure flap outer surface, said glasses pouch being for storing optical glasses therein.

* * * * *